US005892335A

United States Patent [19]

Archer

[11] Patent Number: 5,892,335

[45] Date of Patent: Apr. 6, 1999

[54] GAS DISCHARGE LAMP WITH ACTIVE CREST FACTOR CORRECTION

[75] Inventor: Michael P. Archer, Westlake Village, Calif.

[73] Assignee: Eos Corporation, Camarillo, Calif.

[21] Appl. No.: 838,332

[22] Filed: Apr. 8, 1997

[51] Int. Cl.[6] ..... H05B 37/02

[52] U.S. Cl. ..... 315/247; 315/224; 315/307

[58] Field of Search ..... 315/200 R, 224, 315/247, 246, 291, 307, DIG. 5, DIG. 7, 206, 207, 208

[56] References Cited

U.S. PATENT DOCUMENTS 4,251,752 2/1981 Stolz ..... 315/206

*Primary Examiner*—Don Wong
*Assistant Examiner*—David H. Vu
*Attorney, Agent, or Firm*—Seldon & Scillieri, LLP

[57] ABSTRACT

A new circuit for the operation of gas discharge lamps via a converter that operates directly off the rectified AC line without reactive filtering and consequently maintains good power factor and low total harmonic distortion while still maintaining an acceptable lamp current crest factor. The converter employs active crest factor correction to control the actual lamp current to a determined peak to RMS value. The design comprises two stages: a first stage with a non-linear input voltage to lamp current transfer function and a second stage having a frequency modulation to lamp current transfer function designed to cancel the first stage's transfer function at a predetermined input voltage and thus maintain constant lamp current during the correction interval.

1 Claim, 3 Drawing Sheets

GAS DISCHARGE LAMP WITH ACTIVE CREST FACTOR CORRECTION

BACKGROUND ART

1. Field of Invention

The present invention relates generally to converter circuits, and in particular to converter circuits used to drive gas discharge lamps.

2. Background Art

Current gas discharge lamps generally require a high power factor and good (i.e., less than 20%) total harmonic distortion (THD). These requirements coupled with output current crest factors imposed by manufacturers of gas discharge lamps, drive designers to utilize various conditioning circuits in the front end of current ballast designs. One of the primary design requirements is of course cost, and any use of conditioning circuits on the front end adds to the cost of the ballast design.

A ballast which accomplishes good THD and power factor, while also maintaining a crest factor within the requirements of bulb manufacturers' recommendations (1.7) without the need for a front end correction circuit is very desirable for cost and efficiency reasons but has been elusive due to the conflicting requirements listed above.

Additionally, active correction circuits are switching power systems on their own. The resulting efficiency of the total lighting product is the product of the efficiencies of the two converters, the active front end converter and the ballast power transfer converter efficiency. This limits the total system efficiency to the high eighties even when the ballast converter efficiency is very high.

SUMMARY OF THE INVENTION

The present invention provides a new ballast topology, which allows the operation of gas discharge lamps through the use of a converter that operates directly off a rectified AC line without reactive filtering and consequently maintains good power factor and total harmonic distortion while still maintaining an acceptable bulb crest factor. The converter employs a new technique, called active crest factor correction, to control the actual bulb current to a preprogrammed peak-to-RMS value. There are two components to the design: (1) a ballast power stage with a purposely non-linear input voltage to bulb current transfer function and (2) an active correction stage with a preprogrammed frequency modulation to bulb current transfer function designed to cancel the power stage's transfer function at a predetermined input voltage and thus maintain constant bulb current during the correction interval.

DETAILED DESCRIPTION OF SPECIFIC EMBODIMENTS

One approach to constructing the front end for a ballast would be to simply rectify the AC voltage and supply the rectified haversine to a small capacitor. This capacitor would have to be small enough to insure essentially continuous conduction of the input rectifier but large enough to insure EMI control of the downstream converter. If this technique is utilized with conventional ballast design, however, the bulb current from the ballast drive circuits would have the shape of the haversine and the measured peak-to-rms current would be unacceptable for the bulb, causing premature failure of the gas discharge lamp.

Figure 1:
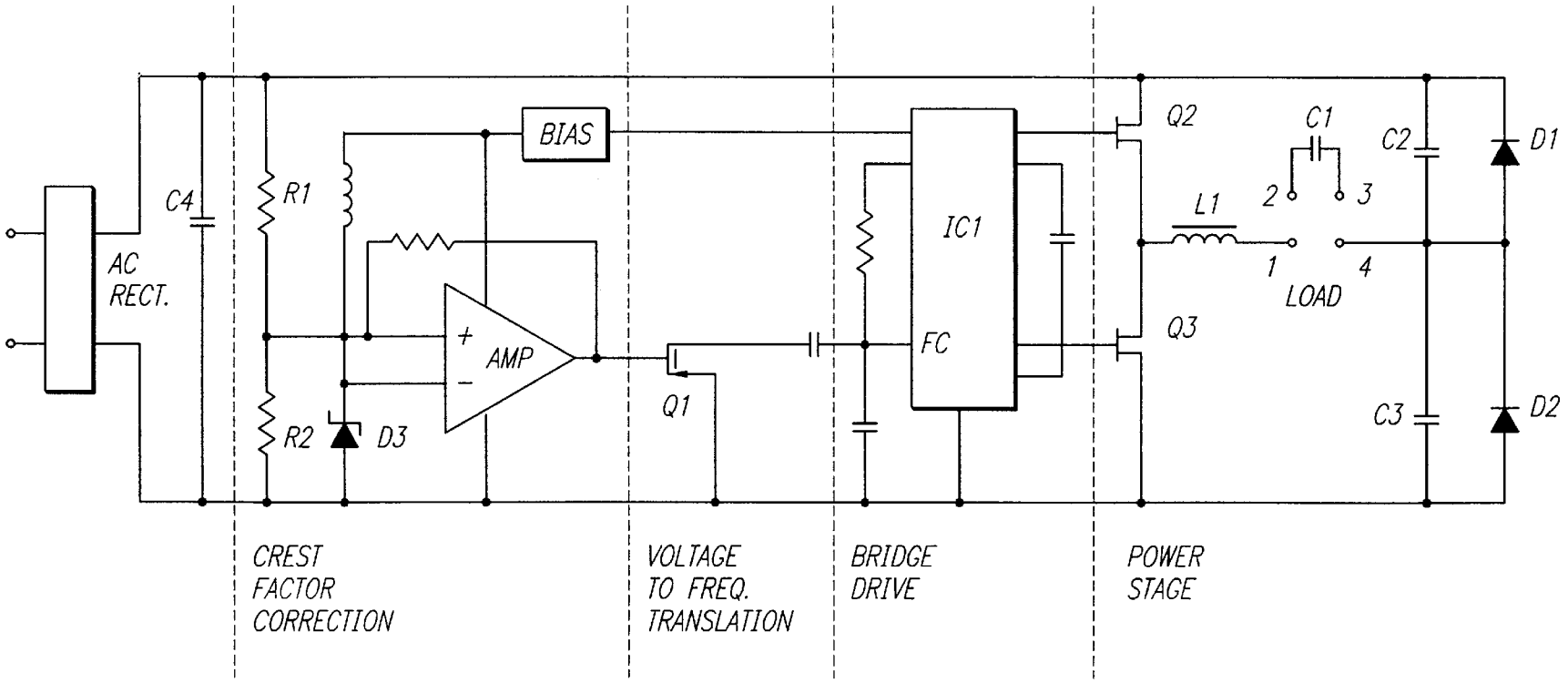
FIG. 1 shows a circuit diagram of a preferred embodiment of the present invention.
Figure 2:
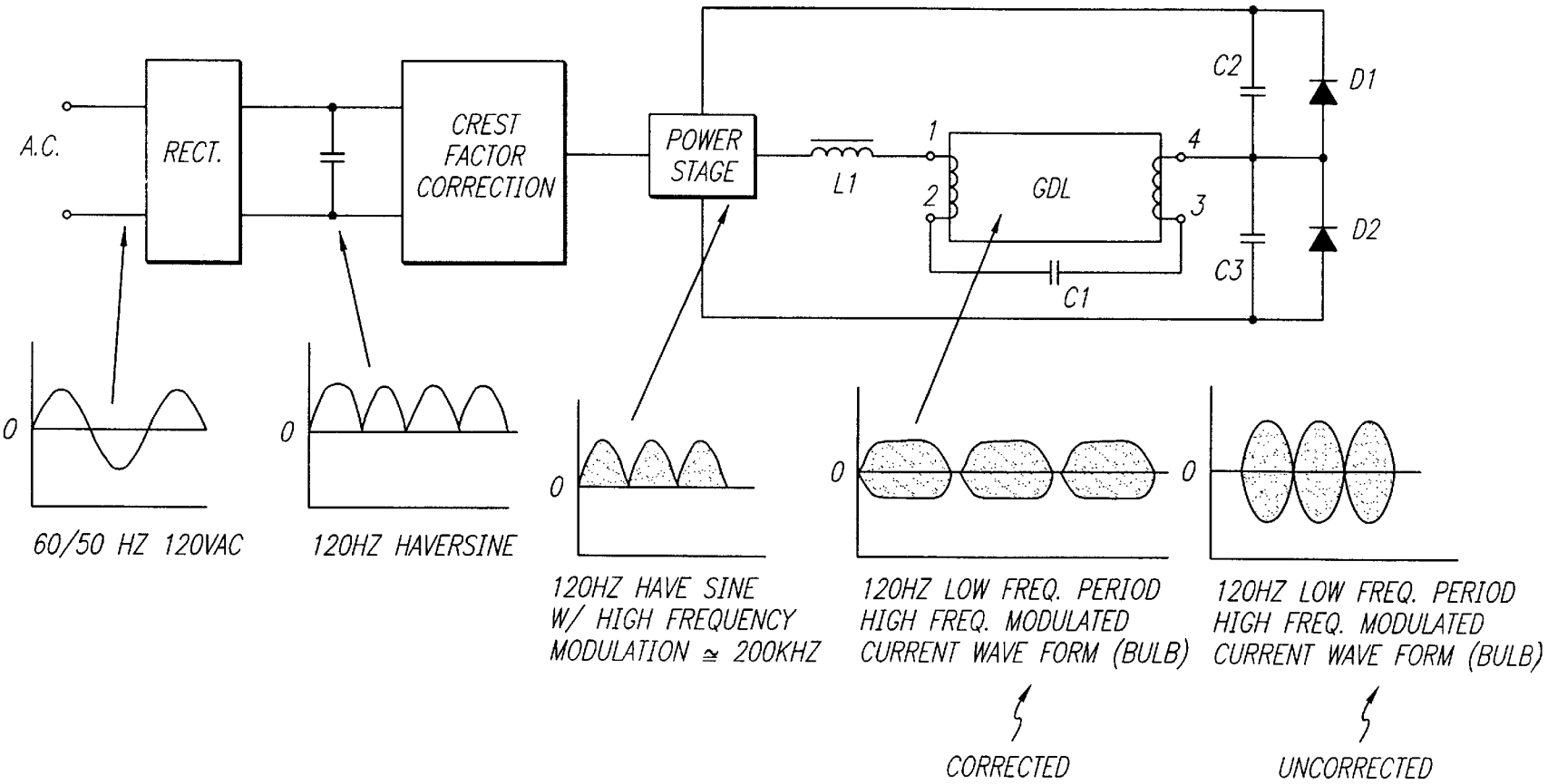
FIG. 2 shows waveform diagrams showing the current waveforms at various points in the preferred embodiment shown in FIG. 1.

FIGS. 1 and 2 show a preferred embodiment of a gas discharge lamp according to the present invention. As shown in FIG. 1, this embodiment includes five stages: (1) AC input; (2) crest factor correction; (3) voltage-to-frequency translation; (4) bridge drive; and (5) power stage.

The AC input stage receives as an input a standard 60 Hz power signal. The power signal is then fed through a rectifier and filtered by capacitor C4. Capacitor C4 is small enough to insure essentially continuous conduction of the input rectifier, but large enough to insure EMI control of the downstream converter.

The rectified, filtered signal is then fed to the crest factor correction stage. The crest factor correction stage includes a pair of resistors R1 and R2 configured as a voltage divider. The output of the voltage divider is fed into the positive terminal of an amplifier. The voltage of the negative terminal of the amplifier is established from a Zener diode D3.

The output of the amplifier of the crest factor correction stage is then fed to the voltage-to-frequency translation stage, comprising a field-effect transistor Q1. FET Q1 works in conjunction with the crest factor correction stage such that when the rectified power signal exceeds a predetermined threshold, defined by voltage divider R1–R2 and Zener diode D3, FET Q1 turns on, providing a signal that is used to control the frequency of the output of bridge driver IC1. When the rectified power signal is below the predetermined threshold, FET Q1 is off, so that the frequency of the output of bridge drive IC1 remains unaffected.

The bridge driver stage includes integrated circuit bridge driver IC1, which includes two outputs that are used to drive switching transistors Q2 and Q3. The IC bridge driver also includes a voltage output that is used to provide a bias voltage used to power the amplifier in the crest factor correction stage and also, in concert with Zener diode D1, provide the reference input to the negative input terminals of the amplifier. Bridge driver IC1 further includes a frequency control input FC, which receives the frequency control signal from the voltage-to-frequency translation stage.

The power stage includes a pair of switching transistors Q2 and Q3 connected into a half-bridge configuration. The output of the half-bridge inverter is fed into an inductor L1. As shown in FIG. 2, the inductor is tied to pin 1 of the filament of the lamp bulb load GDL driven by the circuit. Pin 4 at the opposite end of the bulb is tied to a capacitive divider C2 and C3 with clamping diodes D1 and D2 across each capacitor. A resonant capacitor C1 is connected across the bulb, tied to the remaining filaments at pins 2 and 3.

Figure 3:
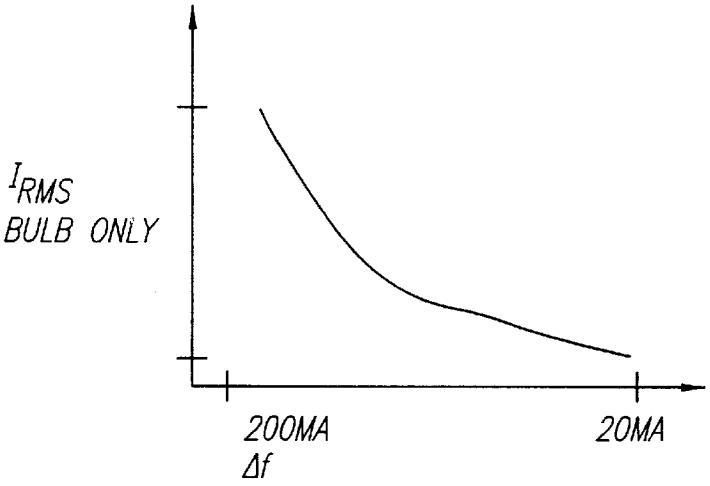
FIG. 3 shows a graph of bulb current (RMS) as a function of frequency.

Drive circuit IC1 operates at high frequencies, in the range of 200 kHz. The resonant circuit formed by inductor L1 and resonant capacitor C1 is tuned to the output of the drive circuit. The bulb current decreases as the frequency of the output of the drive circuit moves away from (above) resonance. The relationship between bulb current and output frequency is shown in FIG. 3.

The operation of the circuit can be better understood with reference to the circuit diagram and waveforms shown in FIG. 2. FIG. 2 shows the sinusoidal 60 Hz AC input voltage.

The AC input is then rectified and filtered, resulting in the 120 Hz haversine. The haversine is used as the power input to switching transistors Q2 and Q3 in the power stage of the circuit.

It is important to note that the voltage source for the ballast is constantly changing from zero voltage to the peak voltage of the rectified line, i.e. 1.414 times the AC voltage.

Figure 4:
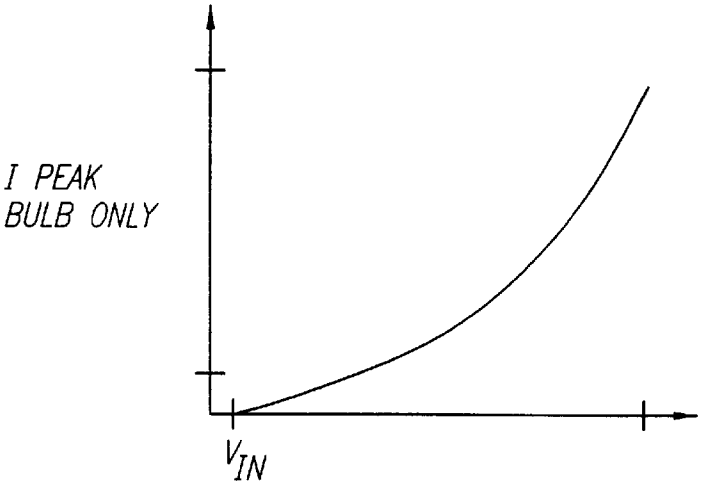
FIG. 4 shows a graph of bulb current (RMS) as a function of peak input voltage in a circuit without active crest factor correction.

For any excitation frequency on the half-bridge drive, there is a given series impedance via the resonant circuit comprising L1 and C1 Additionally, current is limited by the impedance of the capacitive divider formed by capacitors C2 and C3. The power delivered through the resonant circuit follows the formula $\frac{1}{2}CV^2F$ where C is C1, V is the instantaneous voltage supplied to the bridge network, and F is the bridge excitation frequency. Since the input voltage to the bridge is a haversine, the bulb current has a transfer function as seen in FIG. 4. The current in the bulb during low voltages of the haversine are relatively linear despite the nonlinear of the resonant circuit due to the actions of D1 and D2 which are in clamp during this phase of the converter. If the frequency of the bridge driver output were to remain fixed, the bulb current would rise as the haversine voltage rose. The resulting bulb current would be approximated by the waveform shown in FIG. 2. The waveform is a representation of the "envelope" of both low-frequency components (120 Hz from the rectified line voltage) and the high-frequency component from the half-bridge operation of switching transistors Q2 and Q3. As this waveform demonstrates, the peak-to-RMS voltage value of the waveform is poor due to the peaking of the current waveform. Left uncorrected, this crest factor (peak/RMS current) of approximately 2.5. This crest factor is very undesirable for bulb life due to the high working voltage on the filament and will cause early failure of the filament and, consequently, the bulb.

The waveform shown in FIG. 2, demonstrates a corrected bulb current envelope, which has a crest factor of approximately 1.6. To achieve this correction, the transfer function of the ballast power stage as depicted in FIG. 4 must be corrected.

The frequency modulation transfer function of the converter is depicted in FIG. 3. This transfer function would be pertinent to the converter for any fixed input voltage, and is due to the fact that the impedance of the network comprising L1 and C1 is frequency dependent. As the converter is moved away from resonance (i.e., above resonance), the impedance rises, thus lowering the bulb current. This relationship would normally be linear except for the effect of clamping diodes D1 and D2 which are in clamp as the converter approaches resonance and out of clamp at light loads. The crest factor control block in FIG. 2 receives information from a resistive divider R1–R2 off of the high voltage haversine. When the haversine voltage reaches a predetermined point, the amplifier enters its active area and begins to alter the frequency of the converter, raising the converter frequency in direct relationship to the haversine voltage. However, this frequency adjustment takes place above the predetermined point only. As discussed above, this predetermined point is defined by Zener diode D3, and by FET Q1 in the voltage-to-frequency translator stage. Voltage-controlled oscillator integrated circuit IC1 is of a type well-described in the prior art.

Figure 5:
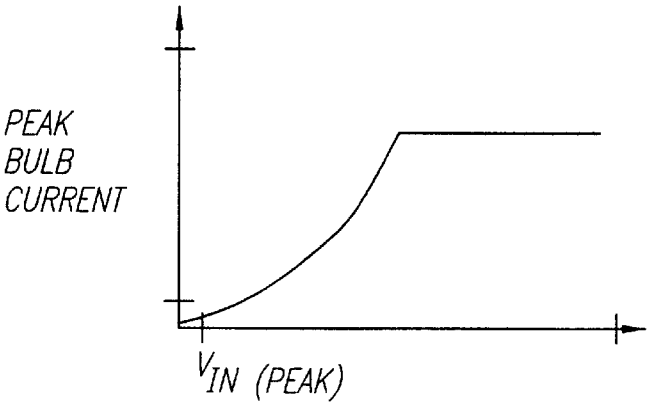
FIG. 5 shows a graph of correct peak current as a function of $V_{in\ (Peak)}$.

The transfer function of the total converter (input-to-output transfer function), including the correction circuit, is shown in FIG. 5. This transfer function is bulb current vs. input haversine voltage to the ballast. As can be seen from this figure, the bulb current becomes essentially constant at the programmed crest factor point.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

What is claimed is:

1. A circuit for driving a gas discharge lamp comprising:

AC input means for receiving an AC power signal as an input and for rectifying and filtering the AC power signal to produce a continuous haversine waveform;

crest factor correction means comprising:

means for receiving the haversine waveform as an input;

means for defining a threshold voltage;

amplifier means for comparing the haversine voltage with the threshold voltage and providing as an output a signal proportional to the difference between the haversine voltage and the threshold voltage;

voltage-to-frequency translation means for providing as an output a frequency control signal when the haversine voltage exceeds the threshold signal;

driver circuit means for providing a high-frequency output signal for an inverter circuit, the output of which is used to drive a gas discharge lamp load;

clamping means for clamping the current flowing through the lamp load;

resonant circuit means into which the lamp is connected, the driver circuit including a frequency control terminal receiving as an input the frequency control signal, such that when the haversine waveform is below the threshold, the driver circuit operates at or near the resonant frequency of the resonant circuit, and such that when the haversine waveform exceeds the threshold, the frequency of the driver circuit moves away from the resonant frequency of the resonant circuit.

* * * * *